US010222746B2

(12) United States Patent
Sarchi et al.

(10) Patent No.: US 10,222,746 B2
(45) Date of Patent: Mar. 5, 2019

(54) MECHANICAL TIMEPIECE MOVEMENT WITH A LEVER ESCAPEMENT

(71) Applicant: Montres Breguet S.A., L'Abbaye (CH)

(72) Inventors: Davide Sarchi, Renens (CH); Benoit Legeret, Ecublens (CH); Benoit Junod, Peillonnex (FR); Polychronis Nakis Karapatis, Premier (CH)

(73) Assignee: Montres Breguet S.A., L'Abbaye (CH)

( * ) Notice: Subject to any disclaimer, the term of this patent is extended or adjusted under 35 U.S.C. 154(b) by 23 days.

(21) Appl. No.: 15/373,514

(22) Filed: Dec. 9, 2016

(65) Prior Publication Data

US 2017/0185041 A1 Jun. 29, 2017

(30) Foreign Application Priority Data

Dec. 23, 2015 (EP) ..... 15202458

(51) Int. Cl.
*G04C 5/00* (2006.01)
*G04B 15/14* (2006.01)
(Continued)

(52) U.S. Cl.
CPC ..... *G04B 15/14* (2013.01); *G04B 15/08* (2013.01); *G04B 15/12* (2013.01); *G04C 5/005* (2013.01)

(58) Field of Classification Search
CPC ..... G04B 15/08; G04B 15/12; G04B 15/14; G04C 5/005
See application file for complete search history.

(56) References Cited

U.S. PATENT DOCUMENTS 2,669,089 A * 2/1954 Straumann ..... G04B 15/12 368/124
2,964,901 A * 12/1960 Beyner ..... G04B 15/12 368/133
(Continued)

FOREIGN PATENT DOCUMENTS

CH 286913 11/1952
CH 573 136 2/1976
(Continued)

OTHER PUBLICATIONS

European Search Report dated May 3, 2016 in European Application 15202458.4, filed Dec. 23, 2015 (with English Translation of Categories of cited documents & Written Opinion).

*Primary Examiner* — Daniel Wicklund
(74) *Attorney, Agent, or Firm* — Oblon, McClelland, Maier & Neustadt, L.L.P.

(57) ABSTRACT

The mechanical timepiece movement includes an escapement having a pallet-lever arranged to move alternately into abutment with two banking elements in locking periods. The pallet-lever carries at least a first permanent magnet and the timepiece movement further includes a first element and a second element of high magnetic permeability and a second magnet and a third magnet respectively integral with first and second elements of high magnetic permeability and each arranged on an opposite side to a first magnet relative to the respective elements of high magnetic permeability. This magnetic system generates, in a first part of a first half vibration of any vibration of the pallet-lever, an overall force of magnetic attraction, defining a magnetic draw additional to the mechanical draw generated by the escape wheel, and, in a second part of this first half vibration, an overall force of magnetic repulsion.

8 Claims, 7 Drawing Sheets

(51) Int. Cl.

| | |
|---|---|
| ***G04B 15/06*** | (2006.01) |
| ***G04B 15/12*** | (2006.01) |
| ***G04B 15/08*** | (2006.01) |

(56) References Cited

U.S. PATENT DOCUMENTS

| | | | | | |
|---|---|---|---|---|---|
| 2,971,324 | A | * | 2/1961 | Beyner | G04B 15/08 310/39 |
| 3,183,426 | A | | 5/1965 | Haydon | |
| 3,292,438 | A | * | 12/1966 | Korr | G04B 15/00 74/1.5 |
| 3,446,007 | A | * | 5/1969 | Cohen | G04B 11/04 368/128 |
| 3,611,707 | A | * | 10/1971 | Scholz | G04B 1/04 368/125 |
| 3,630,018 | A | * | 12/1971 | Nicholas | G04B 15/08 368/126 |
| 3,956,941 | A | | 5/1976 | Faivre | |
| 2007/0201317 | A1 | | 8/2007 | Houlon | |
| 2015/0220061 | A1 | * | 8/2015 | Stranczl | G04B 15/12 368/132 |
| 2016/0357149 | A1 | * | 12/2016 | Stranczl | G04C 5/005 |

FOREIGN PATENT DOCUMENTS

| | | |
|---|---|---|
| GB | 667885 | 3/1952 |
| WO | WO 2006/045824 A2 | 5/2006 |

* cited by examiner

MECHANICAL TIMEPIECE MOVEMENT WITH A LEVER ESCAPEMENT

This application claims priority from European Patent Application No 15202458.4 of Dec. 23, 2015, the entire disclosure of which is hereby incorporated herein by reference.

FIELD OF THE INVENTION

The present invention concerns a mechanical timepiece movement comprising a balance and an escapement with a pallet-lever associated with the balance. In particular, the invention concerns a Swiss lever escapement.

BACKGROUND OF THE INVENTION

Mechanical timepiece movements equipped with a sprung balance and a Swiss lever escapement have been known for a long time. This escapement comprises a pallet-lever provided with a fork and a guard pin, an impulse pin integral with the balance and cooperating with the fork to provide the balance with impulses for maintaining its oscillation. Next, the timepiece movement further comprises two banking pins or solid bankings for limiting the rotation of the pallet-lever in both directions. These pins define two locking positions for the pallet-lever between which it oscillates.

During each vibration of its oscillation, the pallet-lever passes through various phases: A locking phase, an unlocking phase, an impulse phase and a safety phase. During the locking phase or period, the pallet-lever rests against a banking pin, the escape wheel is immobile and the impulse pin describes an ascending and then descending supplementary arc. The unlocking phase concerns the unlocking of an escape wheel tooth resting on a locking-face of a first pallet-stone of the pallet-lever during each locking phase. This phase is generated by the impulse pin of the balance which rests on a first horn of the fork, with the balance then moving the pallet-lever through an unlocking-angle. During the impulse phase, the second horn of the fork rests against the impulse pin and exerts a force on the latter as a result of the torque provided by the escape wheel, whose aforementioned tooth applies a force on an impulse-face of the first pallet-stone. During this impulse phase, the balance receives an impulse for maintaining its oscillations and the pallet-lever continues its rotational movement through an impulse-angle. Finally, during the safety phase, the impulse pin is released from the fork and describes another ascending and then descending supplementary arc. The pallet-lever then effects the end phase of its rotation through a safety-angle, called the "run to the banking", which ensures that the impulse pin is released from the fork and an escape wheel tooth is correctly positioned on the locking-face of the second pallet-stone.

During the locking phase, the guard pin of the pallet-lever ensures that the pallet-lever remains substantially in its locking-angle position. In a main embodiment, there is provided a safety roller integral with the balance staff and having a slot to allow the pallet-lever to rotate during the coupling between the impulse pin and the fork. The end of the guard pin is located at a short distance from the lateral surface of the safety roller when the pallet-lever is in one of its two locking positions resting on a banking pin. In particular, during the locking phases, when an undesired force acts on the pallet-lever, the pallet-lever may leave its locking position on the pin concerned and the guard pin then comes into contact with the lateral surface of the safety roller, which will result in a disruption to the oscillating motion of the balance. This causes a problem for the proper operation of the regulator. In any event, it is desirable for such an event to be as brief as possible. In a mechanical movement where the source provides mechanical energy to the escape wheel to maintain oscillating motion, as is the case with the Swiss lever escapement described above, draw is caused in the locking phases or periods by the escape wheel cooperating with the pallet stone on which it rests. This mechanical draw defines a return force for the pallet-lever which alternately presses it against the banking pins and returns it to said banking pins after the timepiece movement is subjected to shocks or sharp accelerations which momentarily drive the pallet-lever in rotation.

There are also known timepiece movements wherein energy is provided directly to the balance by a drive source, the balance is then a mechanical drive element which, on the one hand, transmits energy to drive a gear train and on the other hand, is used for regulating the rate of the movement by means for counting its oscillations. In this regard, CH Patent 573136 discloses an electrically maintained balance and a system for counting its oscillations formed by an inverted lever escapement. Electromechanical movements of this type are arranged and operate very differently from timepiece movements equipped with a Swiss lever escapement. In particular, given that the escape wheel is not subjected to an energy source other than that provided by the balance, this escape wheel does not exert any draw as in the case of a mechanical movement in which the drive energy is provided by a barrel, which drives, in particular the escape wheel. Since there is no mechanical draw, this document indicates that draw can be obtained by a magnet mounted on the pallet-lever and two positioning pins a priori made of a ferromagnetic material. These pins continuously attract the pallet-lever, the overall force of attraction being directed towards the pin closest to the magnet, which enables the pallet-lever to be held in its locking positions in which it rests alternately on the pins.

The Swiss lever escapement has proved capable of good regulation of a mechanical timepiece movement. However, this type of escapement remains a complex mechanism and it is sensitive to shocks and to sharp accelerations as explained above. In particular, it is difficult to simultaneously optimise two important parameters which are the efficiency of such an escapement and safety in the event of shocks, since the pallet-lever is the first element affected by these two technical features. It is known that even a small vibration or any rebounding of the pallet-lever during the locking periods results in disruption to the balance (via the guard pin which comes into contact with the safety roller and rubs against the latter), which impairs efficiency and chronometry. In known embodiments, the draw of the pallet-lever and therefore the holding thereof against a banking pin limiting its rotation, are ensured only by a certain torque applied to the pallet-lever by the escape wheel. It is noted that this torque may be too low, or completely lacking during part of the supplementary arc of the pin/balance, particularly in optimised escapements with a substantially constant torque because the escape wheel in such mechanisms advances slowly.

SUMMARY OF THE INVENTION

It is an object of the invention to overcome the aforementioned drawbacks of a conventional lever escapement and in particular to increase the force returning the pallet-lever to the banking pins during the locking periods, while minimising the consequences for chronometry and the efficiency of the escapement, or without impairing the latter and even allowing for some improvement in the dynamic operation of the escapement.

To this end, the invention concerns a mechanical timepiece movement wherein the escapement lever carries at least a first permanent magnet which has an axis of magnetisation oriented substantially tangentially to its circular axis of displacement when the pallet-lever is subjected to movements of rotation, this timepiece movement comprising a first element and a second element of high magnetic permeability respectively arranged on either side of at least a first permanent magnet so as to be substantially aligned on its circular axis of displacement. Next, the timepiece movement is characterized in that it further includes a second permanent magnet and a third permanent magnet respectively integral with the first and second elements of high magnetic permeability and each arranged on an opposite side to said at least a first magnet relative to said two elements of high magnetic permeability, and in that said at least a first magnet and a first assembly formed of the second magnet and the first element of high magnetic permeability, respectively a second assembly formed of the third magnet and the second element of high magnetic permeability, are arranged to generate, between the at least a first magnet and the first assembly, respectively the second assembly, a force of magnetic attraction on a first section of the aforementioned angular distance and a force of magnetic repulsion on a second section of said angular distance, and such that the second section corresponds to distances of separation between them which are greater than the distances of separation corresponding to the first section.

In a preferred embodiment, the first and second elements of high magnetic permeability have respective central axes that are substantially coincident with the respective axes of magnetisation of the second and third magnets, these respective central axes being substantially tangent to the circular axis of displacement of the first magnet.

As a result of the features of the invention, as will be explained in detail hereafter, there is obtained a particular magnetic draw which has the advantage of being exerted over only a relatively short angular distance from the locking position of the pallet-lever abutting on a banking element limiting its rotation. This short angular distance is followed by an angular range in which the pallet-lever is magnetically pushed back from the aforementioned banking element. Thus, in a Swiss lever escapement, in addition to increasing draw and consequently limiting the risk of disrupting the oscillating motion of the balance, the magnetic system of the invention, positively contributes to the transmission, by the pallet-lever, of a maintaining impulse to the balance, up to a central angular position of the pallet-lever. Other features of the invention will also appear from the detailed description of the invention.

BRIEF DESCRIPTION OF THE DRAWINGS

Embodiments of the invention will be described below with reference to the annexed drawings, given by way of non-limiting example, and in which.

DETAILED DESCRIPTION OF THE INVENTION

Figure 1:
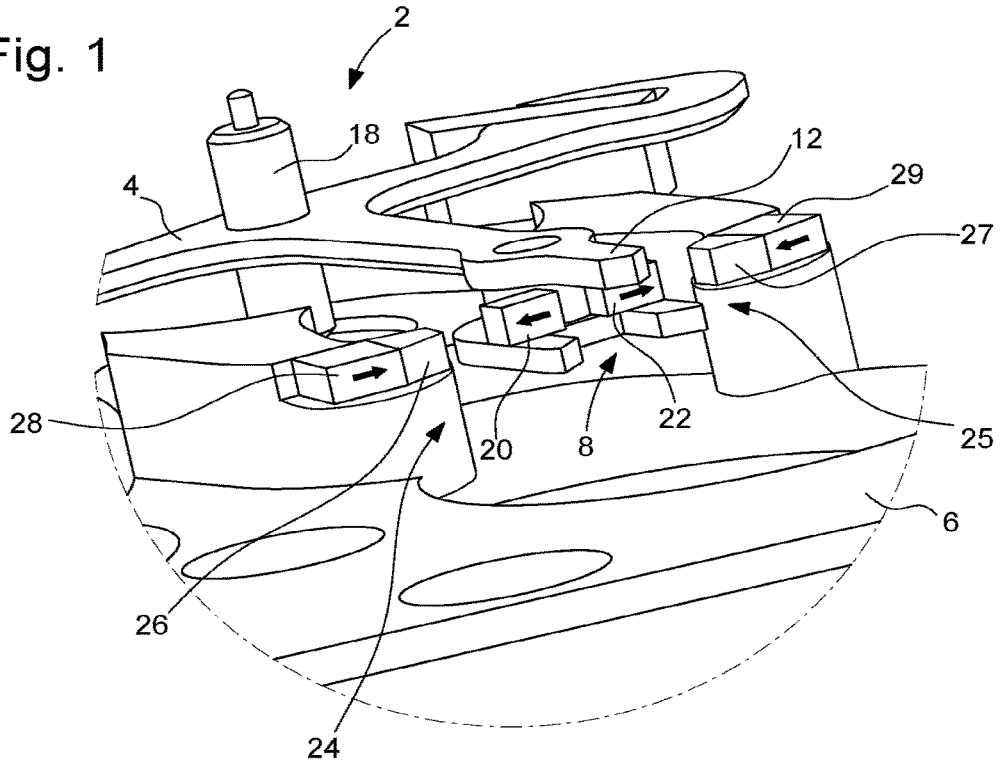
FIG. 1 is a perspective view of a first embodiment of a timepiece movement according to the invention.
Figure 2:
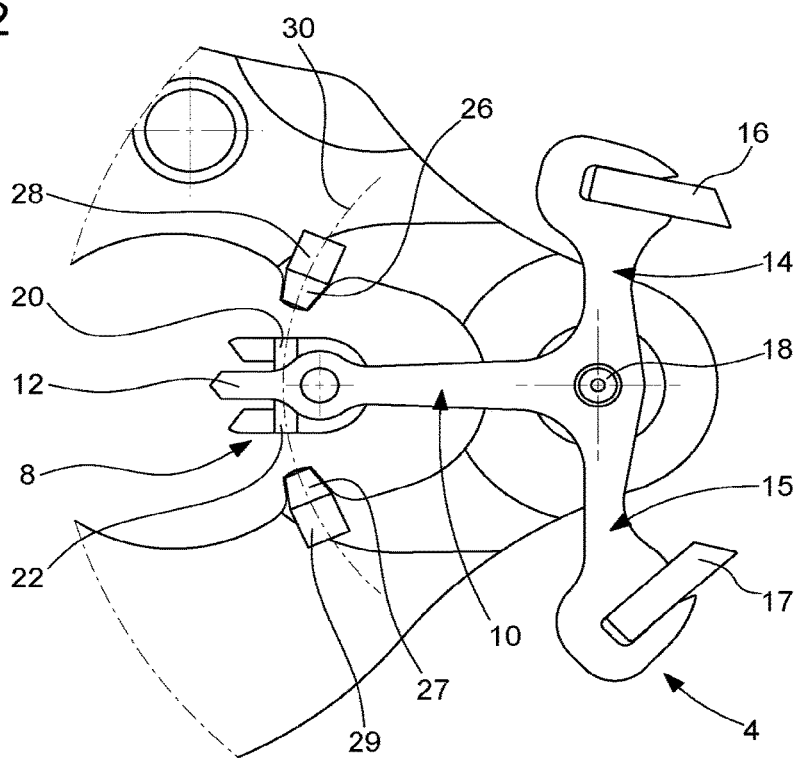
FIG. 2 is a partial top view of the timepiece movement of FIG. 1
Figure 3:
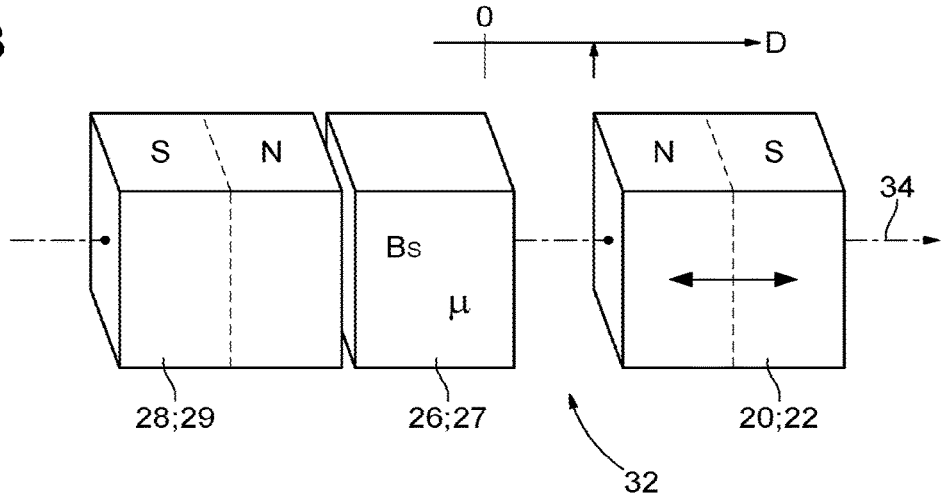
FIG. 3 shows schematically a magnetic device forming part of the magnetic system incorporated in the escapement of the first embodiment.

With reference to FIGS. 1 to 5, there will be described below a first embodiment of a mechanical timepiece movement 2 according to the invention. This timepiece movement comprises a conventional sprung balance (not shown for reasons of clarity of the drawing) and a Swiss lever escapement (the escape wheel is not represented). Pallet-lever 4 is provided, at the end of its lever 10, with a fork 8 and a guard pin 12. It comprises a pivot shaft 18, mounted at one end in a bearing of a plate 6, and, in a conventional manner, two arms 14 and 15 respectively bearing pallet-stones 16 and 17. The pallet-lever may be subjected to rotational motions over an angular displacement distance between two extreme angular positions, which respectively define two locking positions of the pallet-lever. To this end, the timepiece movement comprises two banking elements 24 and 25 for limiting the rotation of the pallet-lever, which are respectively formed by two solid bankings. In a known manner, during operation, the pallet-lever alternatively moves into abutment with the two banking elements in locking periods that occur between the pulses provided to the balance via the pallet-lever.

Pallet-lever 4 carries two permanent magnets 20 and 22, which each have an axis of magnetisation oriented substantially tangentially to its circular axis of displacement 30 when the pallet-lever is subjected to rotational motions during its oscillation. The circular axes of displacement of the two magnets are coincident. Next, the timepiece movement comprises two elements of high magnetic permeability 26 and 27, which are respectively arranged on either side of the assembly formed of the two magnets 20 and 22, so as to be substantially aligned on circular axis 30. In the variant represented in FIGS. 1 and 2, the two magnets 20 and 22 are arranged on fork 8 and the two elements 26 and 27 are respectively mounted on the two banking elements 24 and 25. It will be noted that the two elements of high magnetic permeability and the two banking elements have substantially the same plane of symmetry. The two magnets 20 and 22 are respectively arranged facing the two elements 26 and 27 along circular axis 30.

The timepiece movement further comprises two other permanent magnets 28 and 29, which are respectively integral with the two elements of high magnetic permeability. Magnet 28, respectively magnet 29 is arranged on the opposite side to magnet 20, respectively magnet 22 carried by the pallet-lever with respect to element 26, respectively element 27. Next, in projection along the circular axis of displacement 30, magnet 20 is of opposite polarity to the polarity of magnet 28, and magnet 22 is of opposite polarity to the polarity of magnet 29. The two elements 26 and 27 have respective central axes which are substantially coincident with the respective axes of magnetisation of magnets 28 and 29, these respective central axes being substantially tangent to the circular axis of displacement of magnets 20 and 22. The magnetic system formed of the various aforementioned magnetic elements thus comprises two identical magnetic devices arranged in an inverted manner on either side of a vertical plane of symmetry of the fixed magnetic elements. To explain the operation of each of these two magnetic devices incorporated in the escapement of the invention, there is represented, in FIG. 3, a magnetic device 32, which is similar to the two devices provided in the first embodiment.

Device 32 comprises, on the one hand, a fixed assembly comprising a first magnet 28, respectively 29, and an element of high magnetic permeability 26, respectively 27, and on the other hand, a second magnet 20, respectively 22, which is arranged to move with respect to the fixed assembly. It will be noted that the following explanation is also valid for the other embodiments of the invention. The element of high magnetic permeability is arranged between the first magnet and the second magnet. This intermediate element is arranged to be in contact with or close to the first magnet. It consists, for example, of a carbon steel, tungsten carbide, nickel, FeSi or FeNi, or other alloys with cobalt such as Vacozet® (CoFeNi) or Vacoflux® (CoFe). The element of high magnetic permeability is characterized by a saturation field $B_S$ and a permeability μ. The first and second magnets are, for example, made of ferrite, FeCo or PtCo, rare earths such as NdFeB or SmCo. These magnets are characterized by their remanent field.

The element of high magnetic permeability 26, 27 has a central axis 34 which substantially coincides with the axis of magnetisation of the first magnet and also with the axis of magnetisation of the second magnet. The respective directions of magnetisation of the magnets are opposite; i.e. these magnets have reverse polarities along central axis 34. This central axis corresponds to the axis of displacement of the second moving magnet.

As a result of the arrangement of the element of high magnetic permeability between the two magnets wherein this element is situated and held close to the first magnet or against the latter, moving magnet 20, 22 is subjected to an overall force of magnetic repulsion which tends to move it away from element 26, 27 when the distance between the moving magnet and the element is greater than a distance $D_{inv}$; whereas the moving magnet is subjected to an overall force of magnetic attraction which tends to move it closer to element 26, 27 and, if there is no resistance, to hold it against the element when the distance between the moving magnet and the element is less than distance $D_{inv}$. The overall force of magnetic attraction thus defines a return force or a draw force of the moving magnet towards the element of high magnetic permeability, despite the fact that the two magnets are arranged with reverse polarities. Preferably, the distance between the first fixed magnet and the element of high magnetic permeability is smaller than or substantially equal to one tenth of the length of the first magnet along its axis of magnetisation.

Figure 4:
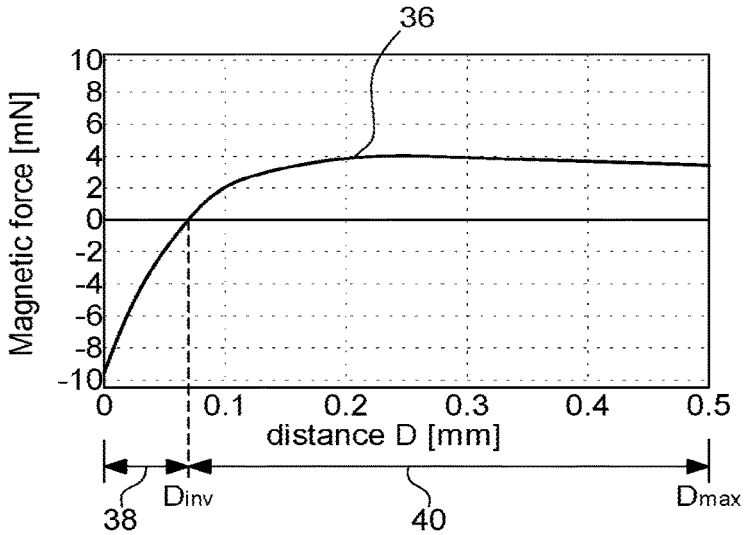
FIG. 4 is a graph showing the magnetic force to which the moving magnet is subjected, in the magnetic device of FIG. 3, as a function of the displacement of the moving magnet.

Curve 36 of FIG. 4 shows the overall magnetic force exerted on the moving magnet. The moving magnet is subjected, on a first section 38 of the relative distance D between the latter and element 26, 27, to an overall force of magnetic attraction that draws it towards the element or presses it against the element when it is in abutment therewith. Next, the moving magnet is subjected, on a second section 40 of relative distance D, to an overall force of magnetic repulsion. This second section 40 corresponds to the distances of separation, and thus to relative distances D, between the element of high magnetic permeability and the moving magnet which are greater than the distances of separation corresponding to the first section 38. Distance $D_{inv\ is}$ therefore a distance of inversion of the overall magnetic force that is applied to the moving magnet. It depends, in particular, on the materials used and the geometry of each of the magnetic elements of magnetic device 32, such as the intensity of the aforementioned magnetic forces. The maximum distance $D_{max}$ between element 26, 27 and moving magnet 20, 22 is generally defined by the timepiece mechanism concerned. In the case of the escapement of the invention, this maximum distance is determined by a banking element 24 or 25, as is the minimum distance between these elements. In the FIG. 4 graph, the minimum distance is zero, but it is possible to arrange the moving magnet, element 26, 27 and the banking element concerned such that this minimum distance is not zero. The maximum force of magnetic attraction can therefore be regulated.

In magnetic device 32, the axes of the magnets and the central axis of the element of high magnetic permeability are coincident and are collinear with the axis of displacement of the moving magnet. However, it will be noted that this magnetic device can remain functional without these conditions, since the direction of relative motion may, in particular, form a certain angle relative to central axis 34. The axis of displacement of the moving magnet may be a circular axis when the magnet is subjected to a rotational movement, as is the case in the escapement according to the invention. In such case, it will be noted that it is preferable that the axes of magnetisation of the two magnets tend to be aligned when the distance between them decreases, in particular in first section 38 of relative distance D.

The remarkable operation of magnetic device 32 is advantageously employed in the escapement of the timepiece movement according to the invention which combines two such identical magnetic devices to generate antisymmetric magnetic behaviour on the angular travel of the pallet-lever between its two locking positions and to define a bistable magnetic system for the pallet-lever in the presence of a mechanical force that is exerted thereon during pulses provided to the balance in both of its directions of oscillation More particularly, first magnet 20 and a first assembly consisting of magnet 28 and the first element of high magnetic permeability 26, respectively second magnet 22 and a second assembly, consisting of magnet 29 and the second element of high magnetic permeability 27, are arranged to generate between the first magnet and the first assembly, respectively the second magnet and the second assembly, a force of magnetic attraction on a first section of an angular distance between them and a force of magnetic repulsion on a second section of said angular distance, and such that the second section corresponds to distances of separation between them which are greater than the distances of separation corresponding to the first section.

Figure 5:
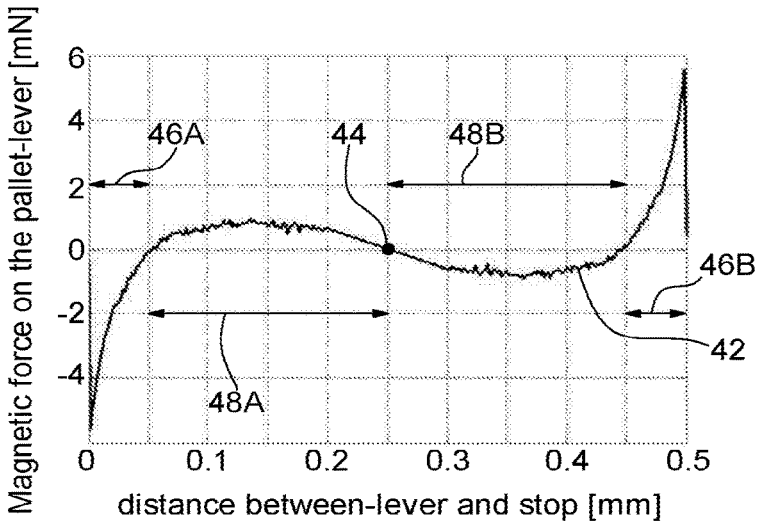
FIG. 5 is a graph showing the overall magnetic force exerted on the escapement lever of the first embodiment as a function of its angular position.

In the FIG. 5 graph, the circular distance between fork 8 and solid bankings 24 and 25 is represented on the abscissa and the ordinate represents the overall magnetic force that is exerted on magnets 20 and 22 carried by pallet-lever 4 in the magnetic system of the escapement which consists of two magnetic devices similar to magnetic device 32. A curve 42 is obtained for this overall magnetic force which has four distinct sections: a first section 46A where the overall magnetic force is a magnetic draw force in the direction of a first element of high magnetic permeability 26, a second section 48A where the overall magnetic force is a force of magnetic repulsion relative to first element 26, a third section 48B where the overall magnetic force is a force of magnetic repulsion relative to the second element of high magnetic permeability 27, and a fourth section 46B where the overall magnetic force is again a magnetic draw force, but this time in the direction of second element 27.

Curve 42 is substantially antisymmetric, with the overall magnetic force cancelled out at central point 44. It is understood that the behaviour of the magnetic system is symmetric, starting from this central point, both in the direction of first banking element 24, and in the direction of second banking element 25 or, in other words, the behaviour of the magnetic system is identical whether the pallet-lever moves from a first banking element towards the second banking element or vice versa. Thus, the magnetic forces are identical in both directions of rotation of the pallet-lever and thus in each of its vibrations. The aforementioned first and second assemblies and the respective moving magnets carried by the pallet-lever are arranged such that an overall magnetic force exerted by the first and second assemblies on the two moving magnets, and thus on the pallet-lever, is substantially cancelled out when the geometric centre of the two magnets is located substantially in the plane of symmetry of the first and second assemblies (at central point 44). Next, starting from this plane of symmetry along the circular axis of displacement of the moving magnets towards the first assembly, respectively the second assembly, the overall magnetic force defines, in a first angular range (section 48A, respectively 48B), a force of magnetic repulsion and then, in a second angular range (section 46A, respectively 46B) approaching the first assembly, respectively the second assembly, a force of magnetic attraction relative to the first or second assembly. The magnetic system according to the invention thus generates, in a first part of a first half vibration of any vibration of the pallet-lever, an overall force of magnetic attraction, defining a magnetic draw additional to the mechanical draw generated by the escape wheel, and, in a second part of this first half vibration, an overall force of magnetic repulsion.

There will be described below, with reference to FIGS. 6A to 9, a second embodiment of the timepiece movement according to the invention, in particular of its escapement 52, and further explanations will be provided as to the operation of this escapement in relation to the overall magnetic force which is applied to the pallet-lever in the magnetic system described above. This second embodiment has a magnetic system incorporated in the escapement, which operates in a similar manner to that found in the first embodiment. Escapement 52 essentially differs from the escapement described above in that it comprises a single moving magnet 54, carried by the pallet-lever 4A. This moving magnet has an axis of magnetisation oriented substantially tangentially to its circular axis of displacement 30 when the pallet-lever is subjected to movements of rotation. The moving magnet has an opposite polarity to the respective polarities of the two fixed magnets 28 and 29 in projection along its circular axis of displacement. The single magnet 54 carried by the pallet-lever replaces the two moving magnets of the first embodiment, such that it interacts with the two fixed magnetic assemblies and forms with each of them a similar magnetic device to the magnetic device 32 described above.

Escapement 52 is further distinguished by its two elements of high magnetic permeability 26A and 27A which are of cylindrical shape. Next, it differs in the positioning of moving magnet 54 on lever 10 of the pallet-lever, as the first and second fixed magnetic assemblies are arranged on either side of this moving magnet along its axis of displacement 30. Finally, in escapement 52, the elements of high magnetic permeability 26A, 27A also form the banking elements limiting the oscillating motion of the pallet-lever, with magnet 54 held in abutment with these elements in the locking periods of the pallet-lever. Thus, the two elements of high magnetic permeability are respectively coincident with the two banking elements. To protect the moving magnet in the event of shocks occurring at the end of the vibrations of the pallet-lever, a protective layer 56 is provided on the two lateral surfaces of this oscillating magnet which respectively move into abutment with the magnetic elements 26A and 27A.

Pallet-lever 4A is provided with a guard pin 12 cooperating with a lateral surface of the pivot shaft or of a roller 58 mounted around the latter, the guard pin being used to prevent the pallet-lever drawing away further than a safety-angle when the pallet-lever is in either of its two locking positions during its locking periods. The balance is represented in cross-section above safety roller 58. This balance comprises an impulse pin 60 integral with its pivot arbor and which cooperates with fork 8A to allow the latter to provide the balance with pulses for maintaining its oscillation by means of a drive force applied to an escape wheel (not represented) which is coupled to the pallet-lever. It will be noted that fork 8A extends lever 10, and guard pin 12 is arranged below the general plane of the pallet-lever.

Figure 6A:
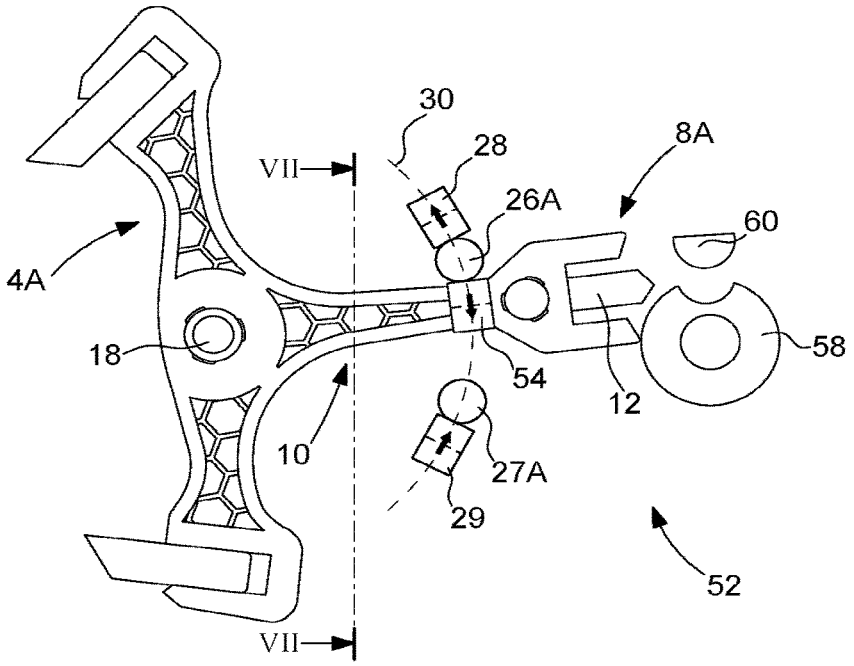
FIGS. 6A and 6B show two possible extreme positions of the lever in a locking period of the latter for a second embodiment of the invention.

FIG. 6A shows pallet-lever 4A in a locking position, with the moving magnet in abutment with magnetic element 26A. It will be noted that, in this configuration, the pallet-lever—stop (banking element) distance is defined as zero. In the variant described here, in the zero position, magnet 54 is, however, at a distance from magnetic element 26A corresponding to the thickness of protective layer 56. In this normal locking configuration which occurs during the pallet-lever locking phases, the pallet-lever is resting on a banking element and it is subjected first to a mechanical draw force via a torque applied to the pallet-lever by the escape wheel, and secondly, according to the invention, a magnetic draw force in the direction of said banking element.

Figure 6B:
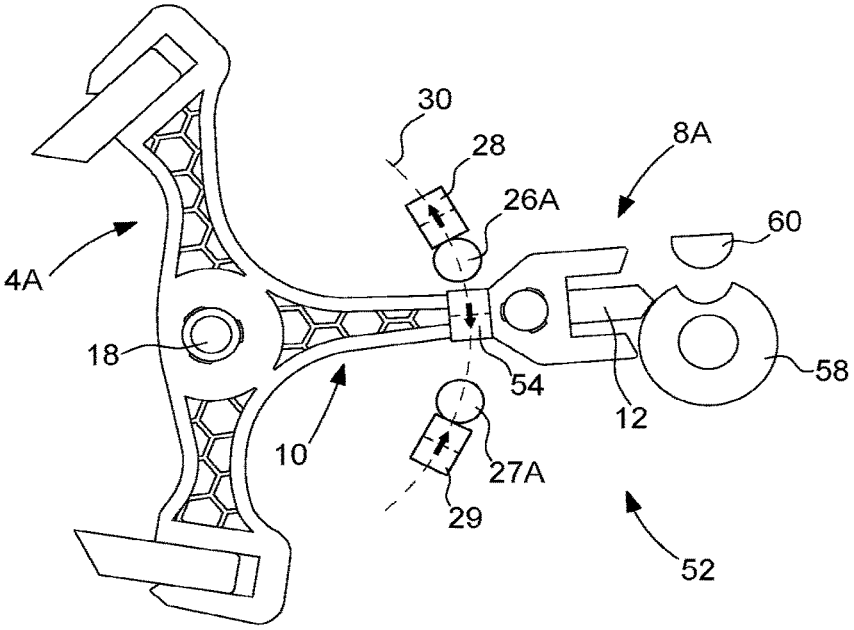
Figure 6C:
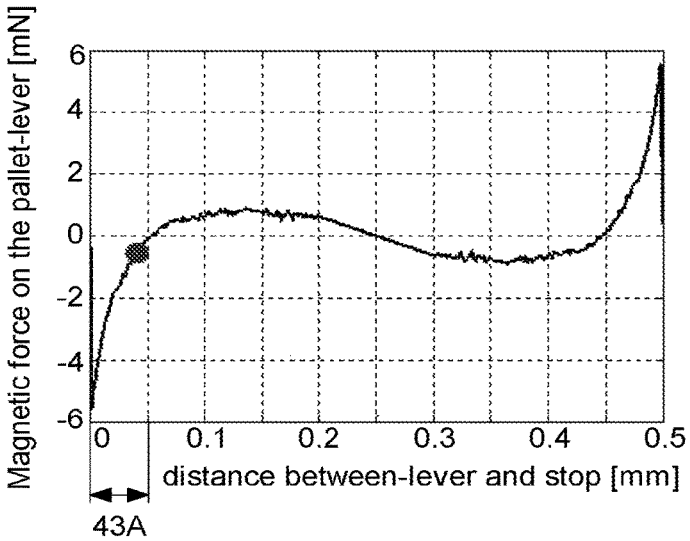
FIG. 6C shows, on the FIG. 5 graph, the angular range corresponding to the clearance of the guard pin in the second embodiment.
Figure 7:
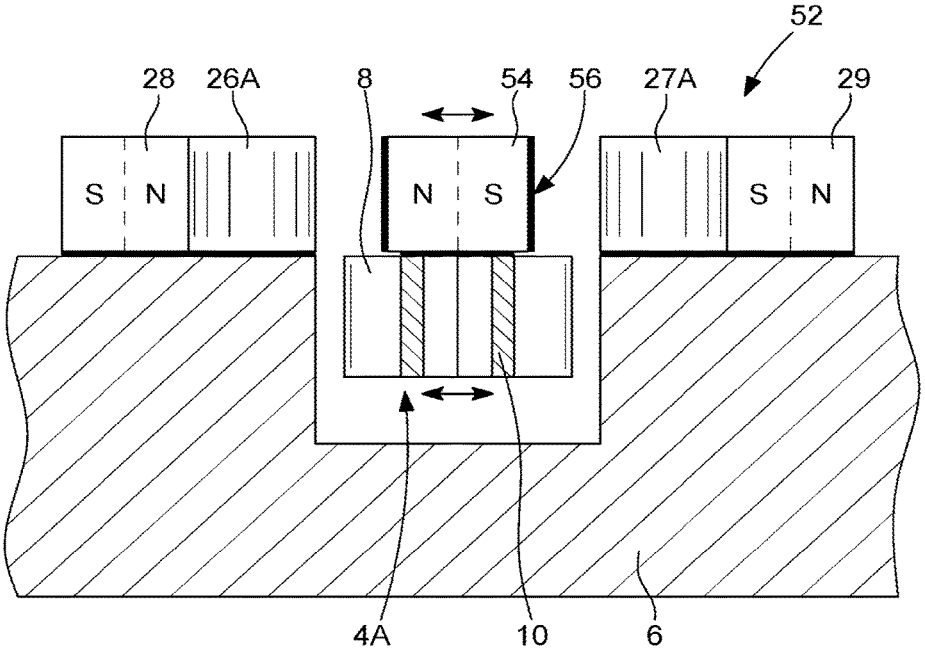
FIG. 7 is a partial side view of the second embodiment from the plane VII -VII of FIG. 6A.

In a preferred variant, the magnetic system of the invention is arranged such that, in the locking periods or phases, the clearance angular distance of guard pin 12 is less than or substantially equal to the magnetic draw angular distance corresponding to section 46A, respectively 46B on the graph of FIG. 5. In these two sections 46A and 46B, the overall magnetic force is a force of magnetic attraction in the direction of the banking element situated, in projection in the general plane of the pallet-lever, closest to the longitudinal axis of lever 10 of the pallet-lever. FIG. 6B shows a configuration where, in the event of a shock, the guard pin momentarily moves into abutment with the lateral surface of roller 60, and FIG. 6C shows that the clearance angular distance of the guard pin is substantially equal here to the angular range of magnetic attraction (magnetic draw). This ensures good functionality of the magnetic draw, by avoiding the magnetic system generating, in case of shocks, a magnetic force that would resist the mechanical draw; which could then increase the effect of disturbances and particularly the guard pin rubbing against the safety roller.

Figure 8A:
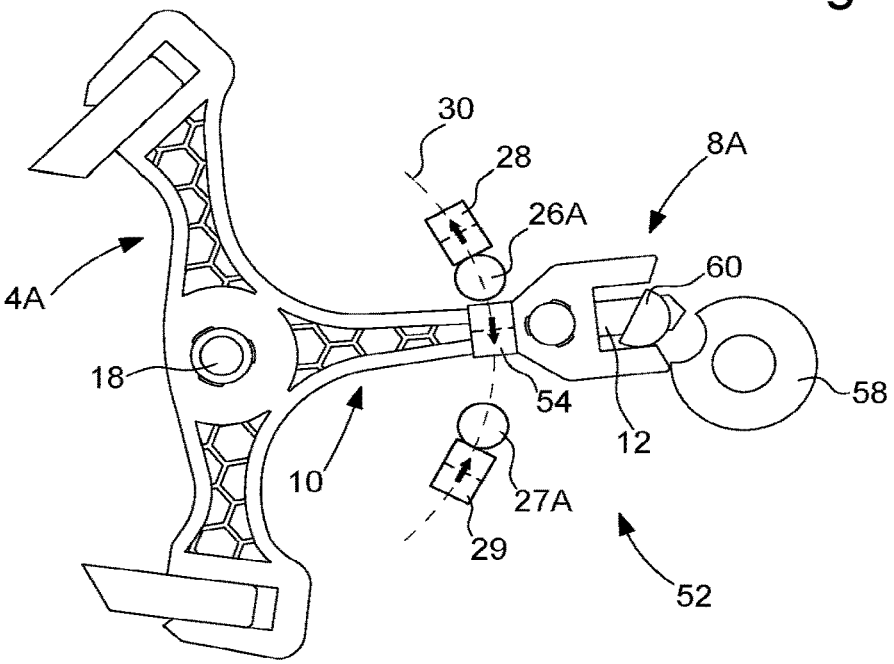
FIGS. 8A, 8B and 8C show the pallet-lever of the second embodiment, respectively in three positions of transition between various phases of a vibration of the pallet-lever.
Figure 8B:
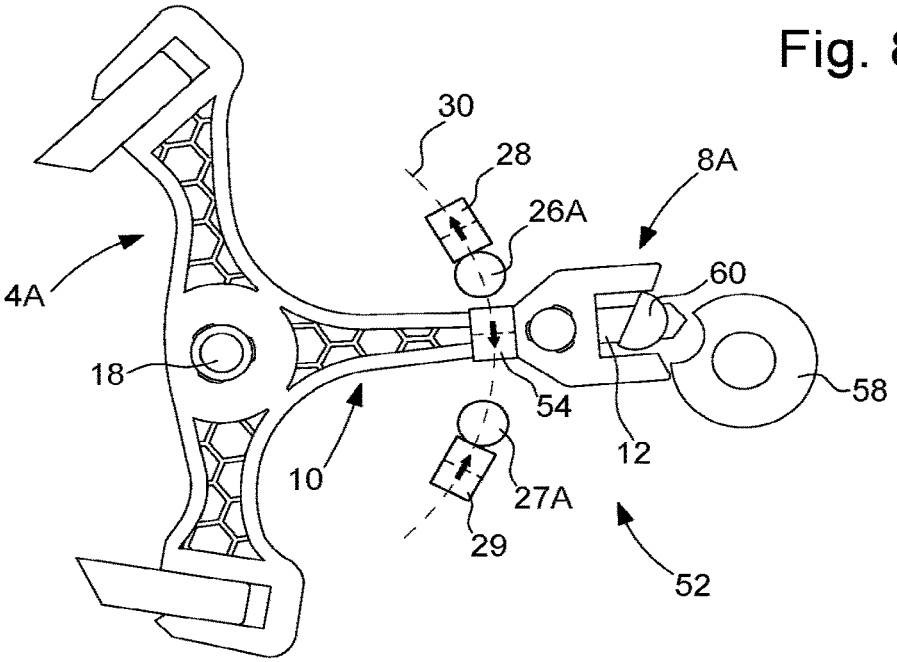
Figure 8C:
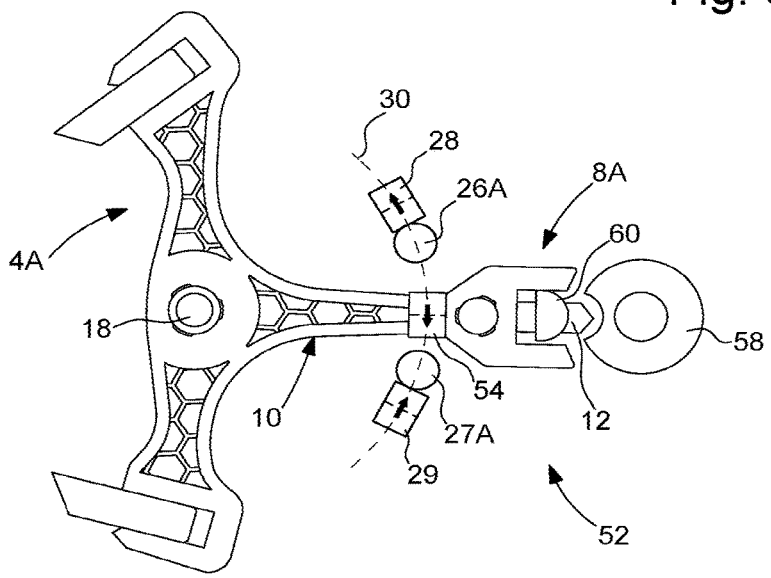
Figure 9:
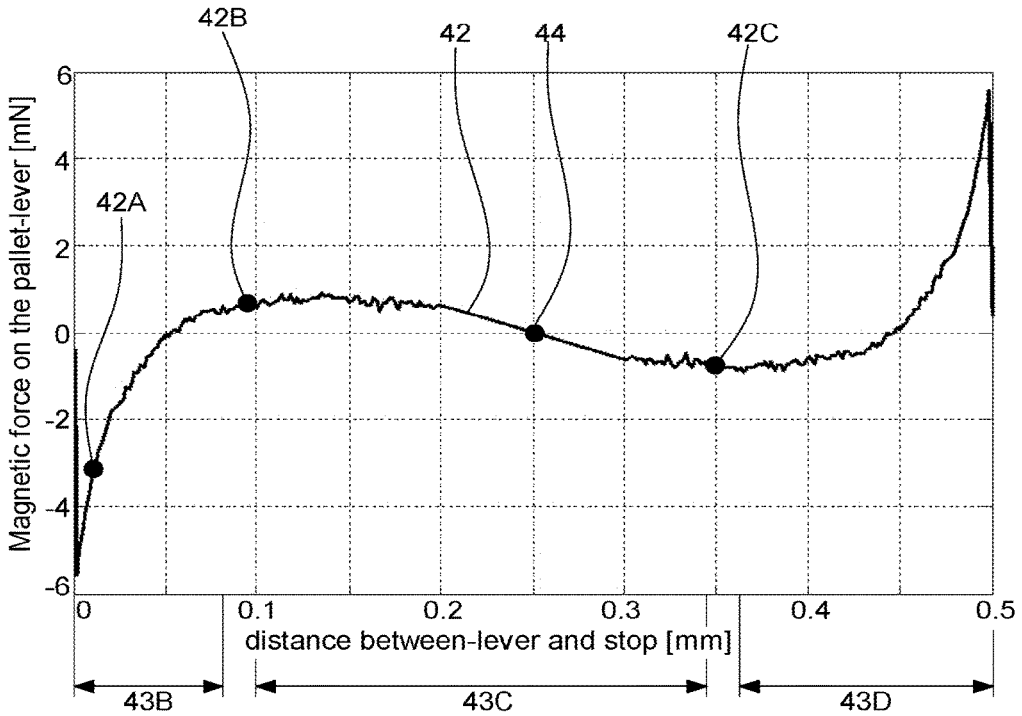
FIG. 9 shows, on the FIG. 5 graph, the three transition positions of FIGS. 8A, 8B and 8C, and the various phases of a vibration of the pallet-lever.

The escapement of the second embodiment is represented in FIGS. 8A, 8B and 8C in three successive positions corresponding to transition areas between various phases of a vibration of the pallet-lever, which were explained above in the background of the invention. These three successive positions are represented in FIG. 9 on the overall magnetic force curve 42 by the three points 42A, 42B and 42C. During the locking phase, the pallet-lever is normally in the zero position in abutment with a first banking element, as represented in FIG. 6A. The angular range between the zero position and first position 42A defines most of the unlocking phase for the pallet-lever. The unlocking of the pallet-lever is arranged to extend, for reasons of safety during the locking phase, over a greater angular distance than the clearance angular distance of the guard pin. During the first part of the unlocking phase, the pallet-lever is subjected to a mechanical draw, generated by the escape wheel, and a magnetic draw. Thus, the magnetic draw and the mechanical draw are complementary and may be dimensioned to optimise the total draw. During unlocking, the balance drives the pallet-lever via the contact between its impulse pin (also known in French as an ellipse because of its shape) and a first horn of the fork. It will be noted that the force of magnetic attraction does not necessarily require excess energy dissipation of the balance to release the pallet-lever, because the extra draw generated by the magnetic draw makes it possible to reduce the mechanical draw and thus optimise the contact between the escape wheel teeth and the pallet-stones. Further, advantageously, this optimisation can enhance the mechanical impulse of the pallet-lever in the impulse phase.

After the actual unlocking, the pallet-lever moves forward under the impulse from the escape wheel until the second horn of the fork collides with the impulse pin (in this description, this catch up period of the balance occurs in the unlocking phase, but it may also be considered as a distinct phase). Initially, the force of magnetic attraction opposes the movement of the pallet-lever but this force rapidly diminishes with the angular distance. The unlocking phase may occur over an angle corresponding to 10%-20% of the total travel of the pallet-lever between the two banking elements preventing its rotation. It will be noted that during the catch up period, the magnetic force is very small and negligible in the example corresponding to curve 42.

Next, substantially as far as angular position 42C, is the impulse phase wherein the pallet-lever provides energy to the balance (maintenance). The corresponding impulse angular distance is represented in FIG. 9. What is remarkable is that during the first part of the impulse angular distance which forms most of said impulse angular distance, the overall force of magnetic repulsion enhances the acceleration of the pallet-lever. In other words, the maintaining impulses are each provided to the balance substantially over an impulse angular distance and the magnetic system of the invention is arranged such that most of this impulse angular distance is situated within the angular range of magnetic repulsion 48A relative to the banking element which moving magnet 54 moves away from in the vibration considered here, i.e. before the central point 44 on the graph of FIGS. 5 and 9.

It will be noted that there is slight magnetic braking at end of the impulse phase (in magnetic repulsion range 48B, which for the vibration concerned here, defines a magnetic braking range for the pallet-lever in rotation). This final magnetic braking dissipates very little energy during the impulse phase. It will be noted that it then continues during the safety phase; which is an advantage for limiting the impact against the second banking element. During the safety phase, after receiving a maintaining impulse, the pallet-lever travels through a safety angular distance before reaching abutment with the second banking element. Preferably, the magnetic system of the invention is arranged such that the safety angular distance is mostly situated within an angular range of magnetic braking of the rotating pallet-lever and thus of magnetic repulsion relative to the second banking element which moving magnet 54 is moving towards. Finally, in the final part of the safety phase, the pallet-lever is accelerated under the effect of an overall force of magnetic attraction towards the second banking element, which again constitutes a mechanical draw force for the next locking period of the pallet-lever.

Figure 10:
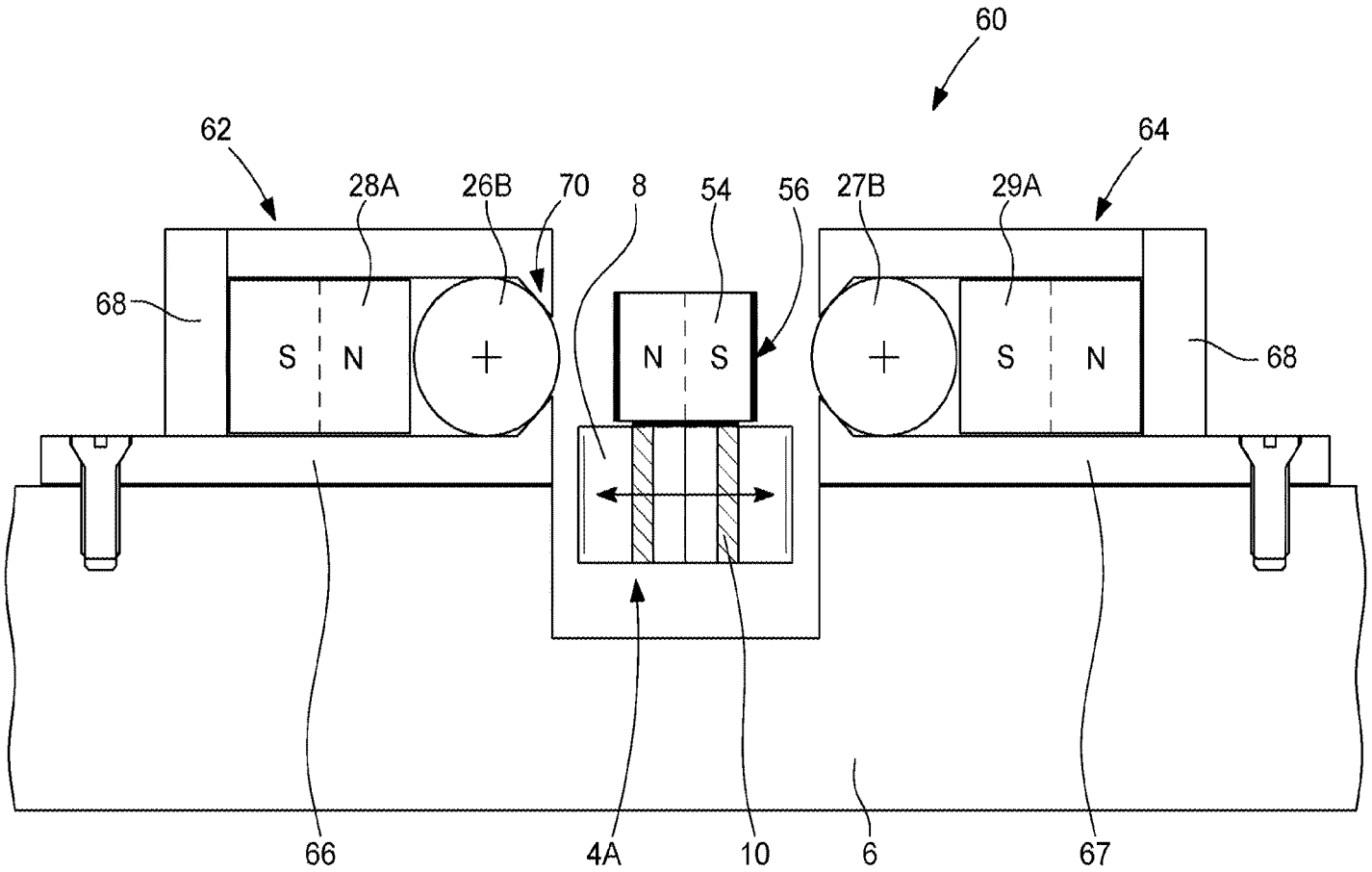
FIG. 10 is a side view, similar to that of FIG. 7, of a third embodiment of the invention.

FIG. 10 represents a side view of the third embodiment in a cross-sectional plane through lever 10 of pallet-lever 4A. Timepiece movement 60 differs from the preceding movement essentially in the shape of the elements of high magnetic permeability 26B and 27B and more generally in the configuration of the two fixed magnetic assemblies 62 and 64. The timepiece movement comprises a base 6 (plate or bridge) on which these two assemblies are arranged. Each magnetic assembly comprises a support 66, respectively 67, in which are arranged a spherical ferromagnetic element 26B, respectively 27B, and a cylindrical magnet 28A, respectively 29A. The support is integral with the base, which is schematically represented by a screw assembling the support to the base. Other securing means may be provided. Each support has a parallelepiped external shape and has a central opening of overall cylindrical or parallelepiped shape. In the case where the opening is parallelepiped, the magnet may also have this shape, as in the examples of the preceding embodiments. At a first end of this central opening, on the side of the spherical ferromagnetic element, is arranged a transverse protuberance 70 forming a stop for the spherical ferromagnetic element, thereby preventing it from leaving the opening entirely, while allowing one part of the element to leave the support so that moving magnet 54 can come into contact with the spherical element. After the spherical ferromagnetic element, arranged in the opening in the corresponding support, is magnet 28A respectively 29A, which is in contact with the spherical ferromagnetic element. On the magnet side, the opening is closed by an end wall 68 welded or bonded to the body of the support.

It will be noted that the spherical shape is advantageous for the elements of high magnetic permeability because it is possible to make ferromagnetic microballs with a very high precision and a very good surface state, without affecting the magnetic properties of these elements. Further, for tribology and in the event of shocks with oscillating magnet 54, it is preferable to rest the pallet-lever against a ball rather than against a flat surface which may be irregular and not perfectly parallel to the hard layer 56 deposited on the lateral surfaces of the magnet.

What is claimed is:

1. A mechanical timepiece movement, comprising:

a balance provided with a pivot shaft;

an escapement associated with said balance, said escapement comprising a pallet-lever provided with a fork;

an impulse pin integral with the balance and cooperating with the fork to allow the latter to provide the balance with impulses maintaining the oscillation thereof by a drive force applied to an escape wheel, which is coupled to the pallet-lever; and two banking elements preventing rotation of the pallet-lever, which define two locking positions of the pallet-lever and between said two locking positions an angular distance for the pallet-lever, said pallet-lever being arranged to move alternately into abutment with the two banking elements in locking periods occurring between said impulses provided to the balance;

wherein the pallet-lever carries at least one permanent magnet which has an axis of magnetisation oriented substantially tangentially to a circular axis of displacement of said at least one permanent magnet, when the pallet-lever is subjected to said movements of said movements of rotation;

wherein the timepiece movement comprises a first element of high magnetic permeability and a second element of high magnetic permeability respectively arranged on either side of said at least one permanent magnet so as to be substantially aligned on the circular axis of displacement, the first element of high magnetic permeability and the second element of high magnetic permeability and the two banking elements having substantially the same plane of symmetry;

wherein the timepiece movement further includes a second permanent magnet integral with the first element of high magnetic permeability and a third permanent magnet integral with the second element of high magnetic permeability, the second permanent magnet being arranged further away from said at least one permanent magnet than the first element of high magnetic permeability, and the third permanent magnet being arranged further away from said at least one permanent magnet than the second element of high magnetic permeability;

wherein said at least one permanent magnet and a first assembly formed of the second permanent magnet and the first element of high magnetic permeability are arranged to generate, between said at least one permanent magnet and said first assembly, a force of magnetic attraction on a first section of said angular distance and a force of magnetic repulsion on a second section of said angular distance, the second section corresponding to a distance of separation between said at least one permanent magnet and said first assembly that is greater than the distance of separation corresponding to the first section, and wherein said at least one permanent magnet and a second assembly formed of the third permanent magnet and the second element of high magnetic permeability are arranged to generate, between said at least one permanent magnet and said second assembly, a force of magnetic attraction on a third section of said angular distance and a force of magnetic repulsion on a fourth section of said angular distance, the fourth section corresponding to a distance of separation between said at least one permanent magnet and said second assembly that is greater than the distance of separation corresponding to the third section.

2. The timepiece mechanism according to claim 1, wherein the first element of high magnetic permeability has a central axis that is substantially coincident with an axis of magnetisation of the second permeant magnet, and the second element of high magnetic permeability has a central axis that is substantially coincident with an axis of magnetisation of the third permeant magnet, said central axis of the first element of high magnetic permeability and the central axis of the second element of high magnetic permeability being substantially tangent to the circular axis of displacement.

3. The timepiece mechanism according to claim 1, wherein said at least one permanent magnet carried by the pallet-lever consists only of a first permanent magnet that has an opposite polarity to a polarity of the second permanent magnet and a polarity of the third permanent magnet in projection along the circular axis of displacement.

4. The timepiece mechanism according to claim 1, wherein said at least one permanent magnet carried by the pallet-lever is formed by a first permanent magnet and a fourth permanent magnet, said fourth permanent magnet also having an axis of magnetisation substantially oriented tangentially to the circular axis of displacement, said first permanent magnet and said fourth permanent magnet being respectively arranged facing the first element of high magnetic permeability and the second element of high magnetic permeability along the circular axis of displacement; and wherein, in projection along the circular axis of displacement, the first permanent magnet has an opposite polarity to a polarity of the second permanent magnet, and the fourth permanent magnet has an opposite polarity to a polarity of the third permanent magnet.

5. The timepiece mechanism according to claim 1, wherein the first element of high magnetic permeability and the second element of high magnetic permeability are respectively mounted on the two banking elements.

6. The timepiece mechanism according to claim 1, wherein the first element of high magnetic permeability and the second element of high magnetic permeability also form the two banking elements so that the first element of high magnetic permeability and the second element of high magnetic permeability are respectively coincident with the two banking elements, and wherein said first element of high magnetic permeability and the second element of high magnetic permeability are of spherical shape.

7. The timepiece mechanism according to claim 1, wherein said first assembly and said second assembly and said at least one permanent magnet are arranged such that an overall force of magnetic attraction, exerted by said first assembly and said second assembly on said at least one permanent magnet, is substantially cancelled out when a centre of said at least one permanent magnet is substantially in said plane of symmetry, and wherein the centre of said at least one permanent magnet, starting from said plane of symmetry along the circular axis of displacement in the direction of said first assembly or said second assembly, defines, in a first angular range, a force of magnetic repulsion relative to said first assembly or said second assembly and then, in a second angular range moving closer to said first assembly or said second assembly, a force of magnetic attraction relative to said first assembly or said second assembly.

8. The timepiece mechanism according to claim 7, wherein the pallet-lever is provided with a guard pin cooperating with a lateral surface of said pivot shaft or of a roller mounted around the latter.

* * * * *